US008418298B2

(12) United States Patent
Jones

(10) Patent No.: US 8,418,298 B2
(45) **Date of Patent: *Apr. 16, 2013**

(54) MASSAGING BED

(75) Inventor: Daniel W. Jones, Overland Park, KS (US)

(73) Assignee: Innovative Standards, Inc., Lenexa, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/479,716

(22) Filed: May 24, 2012

(65) Prior Publication Data

US 2012/0291202 A1 Nov. 22, 2012

Related U.S. Application Data

(63) Continuation of application No. 12/731,404, filed on Mar. 25, 2010, now Pat. No. 8,201,293, which is a continuation of application No. 11/504,406, filed on Aug. 15, 2006, now Pat. No. 7,712,172.

(51) Int. Cl.
*A61H 15/00* (2006.01)
*A47C 27/15* (2006.01)

(52) U.S. Cl.
USPC ..... 5/933; 5/740; 601/98; 601/99; 601/115; 601/116

(58) Field of Classification Search ..... 5/933, 740, 5/655.9, 953, 935; 601/98, 99, 102, 115, 601/116
See application file for complete search history.

(56) References Cited

U.S. PATENT DOCUMENTS

| | | | |
|---|---|---|---|
| 2,310,106 | A | 2/1943 | Miller |
| 2,741,780 | A | 4/1956 | Kimbrig |
| 2,781,040 | A | 2/1957 | Hill |
| 2,874,390 | A | 2/1959 | Sone |
| 2,874,689 | A | 2/1959 | Gavelek |
| 2,909,173 | A | 10/1959 | Anderson |
| 3,003,497 | A | 10/1961 | Nunes |
| 3,039,458 | A | 6/1962 | Hill |
| 3,238,936 | A | 3/1966 | Siedentop |
| 3,252,170 | A | 5/1966 | Frye |
| 3,523,524 | A | 8/1970 | Wilson |
| 3,551,924 | A | 1/1971 | Frye, Sr. |
| 3,664,333 | A | 5/1972 | Hill |
| 3,739,409 | A | 6/1973 | Johnson |
| 3,794,018 | A | 2/1974 | Repko |
| 3,830,233 | A | 8/1974 | Hill |
| 3,877,422 | A | 4/1975 | Heuser et al. |
| 3,882,856 | A | 5/1975 | Heuser et al. |
| 4,061,147 | A | 12/1977 | Falchi |
| 4,109,914 | A | 8/1978 | Matsumoto |
| 4,190,043 | A | 2/1980 | Thompson |
| 4,222,137 | A | 9/1980 | Usami |

(Continued)

*Primary Examiner* — Robert G Santos
(74) *Attorney, Agent, or Firm* — Boyle Fredrickson, S.C.

(57) ABSTRACT

A method and apparatus for a sleep system is provided. More specifically, the invention provides a method and apparatus for an adjustable mattress that allows the user to increase or decrease the firmness of the mattress. Furthermore, the adjustable mattress has zones of adjustability thereby allowing two users to adjust the firmness of the mattress of each user's zone. The adjustable mattress is also multimodal. The motorized foundation contains adjustable massaging units that may be used for physical therapy and relaxation. Likewise, the motorized foundation may be used in relax mode to assist in obtaining sleep and awaken mode to gently awake the user by the stimulation of the adjustable mattress.

36 Claims, 4 Drawing Sheets

U.S. PATENT DOCUMENTS

| | | | | |
|---|---|---|---|---|
| 4,267,610 | A | 5/1981 | Blakeway et al. | |
| 4,458,675 | A | 7/1984 | Nakao et al. | |
| 4,586,493 | A | 5/1986 | Goodman | |
| 4,644,593 | A | 2/1987 | O'Brien | |
| 4,656,998 | A | 4/1987 | Masuda et al. | |
| 4,677,701 | A | 7/1987 | Galumbeck | |
| 5,088,475 | A | 2/1992 | Steffensmeier | |
| 5,165,390 | A | 11/1992 | Fleetwood | |
| 5,233,712 | A | 8/1993 | Jurus et al. | |
| 5,323,499 | A | 6/1994 | Chan | |
| 5,394,577 | A | 3/1995 | James et al. | |
| 5,443,439 | A | 8/1995 | Oshita | |
| 5,504,952 | A | 4/1996 | Ovadia | |
| 5,526,543 | A | 6/1996 | DiMatteo | |
| 5,669,094 | A | 9/1997 | Swanson | |
| 5,688,228 | A | 11/1997 | Lin et al. | |
| 5,708,996 | A | 1/1998 | Marenco | |
| 5,792,080 | A | 8/1998 | Ookawa et al. | |
| 5,862,550 | A | 1/1999 | Cosani | |
| 5,896,604 | A | 4/1999 | McLean | |
| 5,960,496 | A | 10/1999 | Boyd | |
| 6,003,178 | A | 12/1999 | Montoni | |
| 6,159,574 | A | 12/2000 | Landvik et al. | |
| 6,161,234 | A | 12/2000 | Amann | |
| 6,190,338 | B1 | 2/2001 | Arndt | |
| 6,256,821 | B1 | 7/2001 | Boyd | |
| 6,541,094 | B1 | 4/2003 | Landvik et al. | |
| 6,602,579 | B2 * | 8/2003 | Landvik | 428/158 |
| 6,684,433 | B2 | 2/2004 | Giori et al. | |
| 6,799,342 | B1 | 10/2004 | Jarmon | |
| 6,807,698 | B2 | 10/2004 | Torbet et al. | |
| 6,866,915 | B2 * | 3/2005 | Landvik | 428/158 |
| 6,952,852 | B2 | 10/2005 | Reeder et al. | |
| 7,081,098 | B2 | 7/2006 | Kim | |
| 7,273,460 | B1 | 9/2007 | Nan | |
| 7,469,437 | B2 | 12/2008 | Mikkelsen et al. | |
| 7,572,240 | B2 | 8/2009 | Nan | |
| 7,712,172 | B2 | 5/2010 | Jones | |
| 8,201,293 | B2 * | 6/2012 | Jones | 5/740 |
| 2001/0021438 | A1 * | 9/2001 | Landvik | 428/179 |
| 2003/0162000 | A1 * | 8/2003 | Landvik | 428/179 |
| 2008/0045869 | A1 | 2/2008 | Jones | |
| 2010/0235997 | A1 | 9/2010 | Jones | |
| 2011/0270142 | A1 | 11/2011 | Yang | |

* cited by examiner

MASSAGING BED

CROSS REFERENCE TO RELATED APPLICATION(S)

This application is a continuation of U.S. application Ser. No. 12/731,404 filed Mar. 25, 2010, which issued on Jun. 19, 2012 as U.S. Pat. No. 8,201,293, which in turn is a continuation of U.S. application Ser. No. 11/504,406, filed Aug. 15, 2006, which issued on May 11, 2010 as U.S. Pat. No. 7,712,172.

FIELD OF THE INVENTION

The present invention relates to a massaging bed and more particularly to a massaging bed having a mattress configured to accommodate a moving portion of a massaging, apparatus without substantially compromising the compressive resistive properties of the mattress.

BACKGROUND OF THE INVENTION

Sleeping mattress and design are typically of three forms: foam and batting, water bladders, or air bladders. A traditional mattress and foundation combination utilizes a box spring having a series of vertical springs arranged along the entire width and length of the box spring. These provide support for the mattress that is placed on top. The mattress may have various internal components such as vertical springs, wiring, cording, and soft batting materials such as cotton and foam. The firmness of the mattress is a function of the combination of compressive properties of each material. A firm mattress may utilize stiff vertical springs and a dense foam and cotton batting on top to form a "pillow-top". One limitation of these traditional mattress and box-spring combinations is that the firmness of the mattress system can only be achieved by replacing the components, likewise, the firmness of the mattress changes with age of the materials and worn areas or depressed areas may develop.

Water bladders, or more commonly known as waterbeds utilize a bladder, which is filled with water. The firmness of the bed is controlled by the amount of water in the bladder and resulting fluid pressure. Various bladder designs are also available which provide wave support to prevent the water in the bladder from creating a wave. Also multiple bladders may be used to provide various zones of firmness. Like the traditional mattress and box-spring design, adding or removing water may only change the firmness of the water bladder bed. Water has a disadvantage over conventional mattress in that when weight is applied to one location, the displaced water raises the bladder in another area. Another disadvantage of these mattresses is the fact that the bladder can be compromised resulting in the water leaking from the mattress.

The third most common bed configuration is the air mattress. Like a waterbed, the air mattress utilizes a bladder or multiple bladders filled with air. One type of airbed configuration allows two users to adjust each side of the bed independently. The user may adjust the firmness of the bed by pumping air into or removing air from the bladder. The most common types of airbeds typically do not allow the user to adjust the firmness along the length of the bladder such as firmer along the area of the user's lower back is positioned and softer at the head of the bed. A multiple bladder system, using more than one bladder per sleeping area could be used to provide adjustable comfort. However, bladder systems, both air and water, have a disadvantage over conventional mattress in that when weight is applied to one location, the displaced air or water raises the bladder in another area. Thus, if the bladder system is set as soft, a heavy person's mass displaces more air or water at the heaviest areas such as the hips, which raises the head or foot area.

Another alternative of conventional and air or water bladders, is the foam bed. These foam systems may be composed of polyurethane or urethane foams. These mattresses may be used with a conventional box spring and the mattress itself may utilize foam of different densities along the length of the mattress or even spring systems. A disadvantage of the foam bed is that firm of the mattress cannot be adjusted and the foam subject to fatigue and loss of its rigidity.

Recent developments in foam systems include those mattress pads of viscoelastic foams such as Contour-Foam™, Tempurpedic®, Isotonic™ and similar foams. These may be used on top of traditional, air or waterbed to increase the comfort of the bed. Also, new mattress systems use the visco-elastic as a top portion with various foam bases or conventional spring systems. These types of foams conform to the body and provide reduced pressure support. A disadvantage of these systems is that they are not adjustable. Like a traditional mattress, both the visco-elastic foam and urethane foam mattresses need to be flipped, and rotated to prevent localized fatigued areas.

Hospital style beds often use the visco-elastic foam to help prevent pressure sores (subcutaneous ulcers) on bed-confined patents. Most hospital beds have adjustable positions, however, they do not provide adjustable firmness along the length of the bed. Hospitals also utilize air mattress systems that may utilize an active air pump to maintain the pressure in the mattress. These air pumps are typically noisy and often disturbing to the patient.

Although the above bed systems provide various methods of support, they lack the ability to provide adjustability of firmness along the length of the bed (Le. from foot to head). Furthermore, the above bed systems provide only one function—a place to sleep. Thus, it is desirable to have a sleep system that provides for adjustable firmness at multiple locations along the mattress. Furthermore, it is desirable to have a system that provides alternate functions such as compressive massaging. Beside the relaxing properties of massage to aid sleep, massage is also beneficial to persons confined to bed for the relief of localized pressure and increase blood flow to the area of pressure. Likewise, it is desirable to have a bed system that provides an alternative means of wakening such as vibration or even a gentle massage. This type of awaking means is also desired by the hearing impaired.

Previous attempts have been made to provide for automatic massage on a table or bed like foundation. U.S. Pat. No. 3,503,524 by Wilson, utilizes a table platform with foam placed on top. Massaging rollers on a conveyor belt system is located beneath the surface of the table. To make contact with the person lying on the table, a slot having a width greater than the roller is cut into the table and foam and the massaging roller protrudes through the slot. The conveyor belt utilizes multiple rollers, but only provides massage in the area of the slot in the table. As disclosed, the table can take the form of a bed by placing a cushion insert in the slot. This requires the user to get up from the table, retrieve the cushion and place it into the slot. This step is often undesirable such as the case when the user desires the massage to help him or her to relax, reduce tension and assist the person in obtaining sleep. Likewise, if the user falls asleep on the table with the massaging roller intact, the person may roll onto the roller or respond to the roller by moving over. The location of the roller or element is very undesirable in a bed. The cushion for the slot would need a stiff backing to prevent the user's weight from compressing it to prevent the cushion from molding to the belt and roller below. Thus, a massaging bed that automatically converts into a bed without the user getting out or having to move over on the bed to replace a cushion in the bed is desired.

Advances have been made in massaging chairs and recliner models are available. These reclining chairs can provide a very comfortable massage, but also carry a warning that states that the chair is not for sleeping in. Besides the fact that these chairs do not have significant padding between the massaging rollers or massaging heads. This provides significant contact or force into the muscle of the user. Massage chairs are designed to support the user's weight at the seat pan or the chair, arm rests and leg rests. These areas will have more padding and substructure and the quality of the massage is typically less than those areas without the extra padding. These areas requiring padding present problems to the designer. The padding used in the chair must be able to withstand the repetitive action of the massagers that create friction, heat and wear of the padding. In fact, U.S. Pat. No. 7,004,916 to Dehli, recognizes that it is desirable to have chair massager "that preferably does not rattle with age, does not wear away the chair fabric at a considerable rate, and is safe to the user." Likewise, U.S. Pat. No. 6,881,195 to Wu also discusses the need for a fabric for a chair massager that can withstand the wear of the massage rollers, especially in the hollow area of the chair that does not contain significant padding.

SUMMARY OF THE INVENTION

The present invention is directed to a massaging bed that can include a method and apparatus for a multifunctional and multidimensional adjustable firmness sleep system that provides multiple sleep modes, relaxation, sleep and gentle awakening.

One embodiment utilizes a foam mattress placed on a multimodal and powered foundation with a timing device having a user interface.

A second embodiment utilizes foam and powered foundation having pistons and rollers to provide adjustable firmness and massaging and vibration.

A third embodiment utilizes foam and air solenoids to achieve adjustable firmness and provide massaging and vibration.

A fourth embodiment utilizes foam and a powered foundation with pneumatically controlled actuators.

A fifth embodiment utilizes foam and alternative mechanical methods of achieving adjustable firmness and massaging and vibration.

A sixth embodiment utilizes an algorithm to progressively reduce the massaging action to assist in obtaining sleep. This embodiment may alternatively use air noise or other mechanically produced white noise to further assist in obtaining sleep.

Other aspects and advantages of the present invention will be apparent from the following detailed description of the preferred embodiments and the accompanying drawing figures.

DETAILED DESCRIPTION OF THE INVENTION

The invention may be embodied in various forms; however, the invention is described with respect to the following embodiments.

Figure 1A:
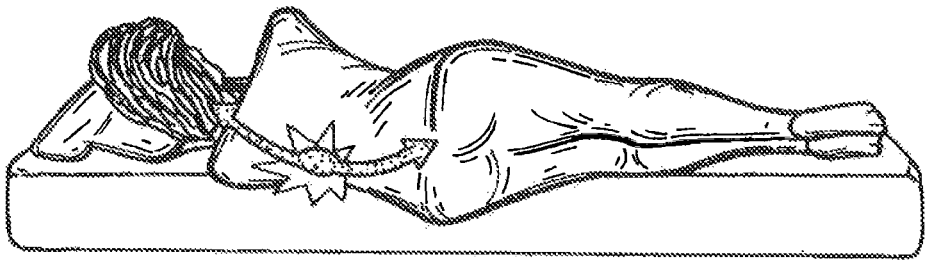
FIG. 1A PRIOR ART
FIGS. 1A-C each illustrates a side plan view respectively illustrating a prior art conventional, air, and water bladder mattress system.
Figure 1B:
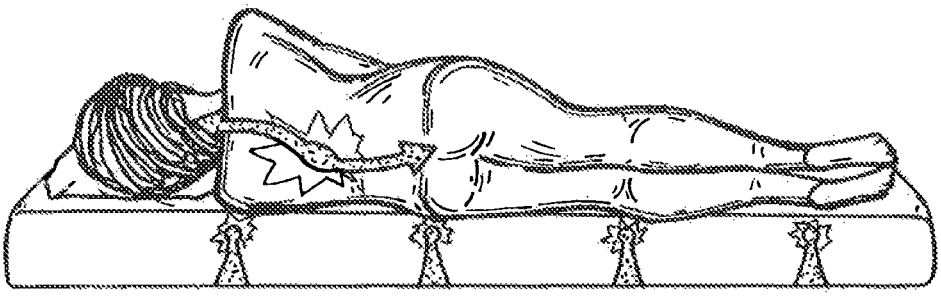
FIG. 1B PRIOR ART
Figure 1C:
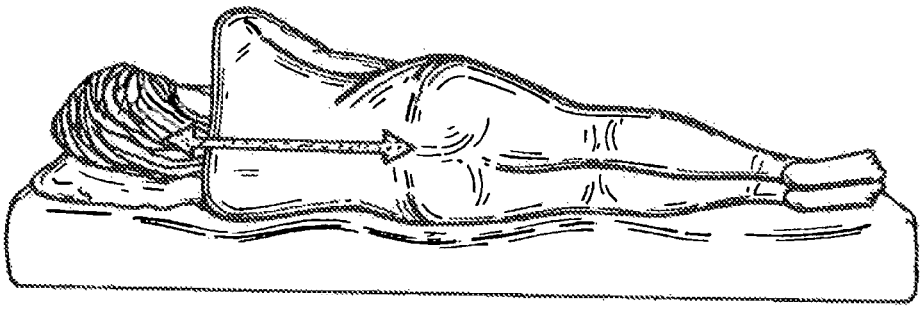
FIG. 1C PRIOR ART

Prior art bed systems typically use a mattress having some type of foam or other foam and cotton batting materials which may not provide adequate support for the user. FIG. 1A illustrates a foam or foam and cotton batting mattress that does not provide adequate support. The heaviest areas of the user compresses the foam more than the lighter areas. As illustrated in FIG. 1A, the user's spine is out of alignment placing pressure the user's shoulder, neck and lower back. In contrast, a mattress that is too stiff provides inadequate support of the contours of the user's body and places pressure on the user's shoulder, hip, knee and ankle as illustrated in FIG. 1B. The best possible posture for sleep is shown in FIG. 1C. The user's spine is in natural alignment and the mattress evenly supports the user's body.

Figure 2:
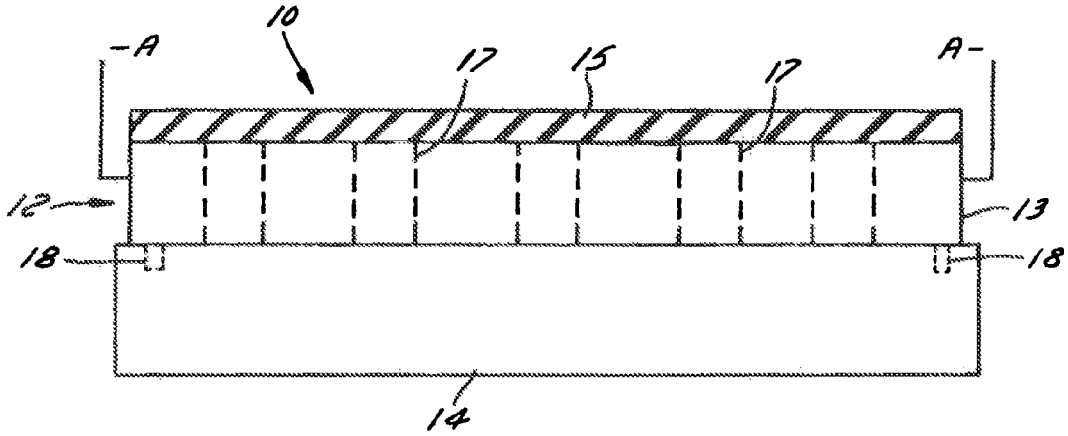
FIG. 2 is a side plan view of a multimodal sleep system constructed in accordance with the present invention.
Figure 3:
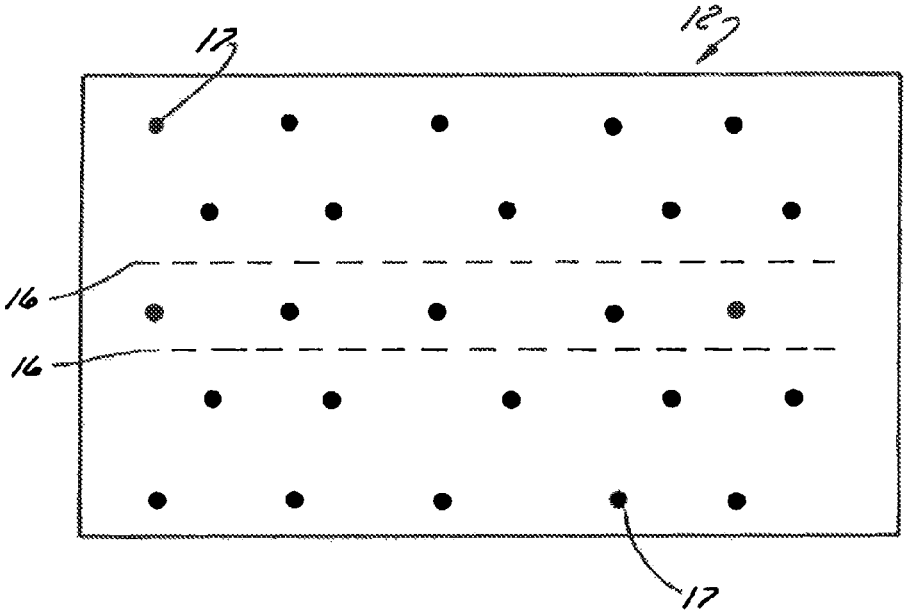
FIG. 3 is a plan view of a mattress of the sleep system of FIG. 2 along line A-A of FIG. 2.

Turning to FIG. 2, one embodiment of sleep system 10 utilizes a visco-elastic foam mattress 12 and a powered foundation 14. In one embodiment, mattress 12 is composed of a mattress body 13 and mattress topper 15. Foam mattress body 13 contains slits 16 that appear like a thin cut in the foam mattress body 13. FIG. 3 illustrates the slits 16 that originate from the underside of mattress body 13 and mates with apparatus (not shown) contained in powered foundation 14. Returning to FIG. 2, restraining member 17 is utilized to maintain a nearly flat surface on the top of mattress 12. Restraining member 17 may be composed of various cording material such nylon, wire, plastic, cotton or similar materials having rigidity. Mattress jacket (not shown) covers mattress 12 and encases mattress body 13 and mattress topper 15. Alignment guides in the form of pins 18 are used to ensure that mattress 12 is aligned with powered foundation 14 and is received in a corresponding hole in powered foundation 14.

Illustrated in FIG. 3 is a cutaway view along plane A-A of FIG. 2 of mattress 12 illustrating the slits 16 that transverse the thickness of foam mattress body 13 from the bottom of foam mattress body 13. Slit 16 opens when the massaging apparatus 21 (not shown in FIG. 3) travels vertically from powered foundation 14 through slit 16 to mattress topper 15. Slit 16 is substantially closed at all times and is made by cutting a slit in foam mattress 12. In contrast, a slot, where foam is removed from the cut, cannot close and leave an interrupted surface. When force is applied to mattress topper 15 with a slotted submattress, that area of the mattress containing a cut, topper 15 sags in the areas above the slots. Therefore, slit 16 is a preferred method of cutting foam mattress 12. Also shown is restraining member 17. Multiple slits 16 may be used along foam mattress 12 to obtain the desired massaging travel pathways or similar function.

Figure 4:
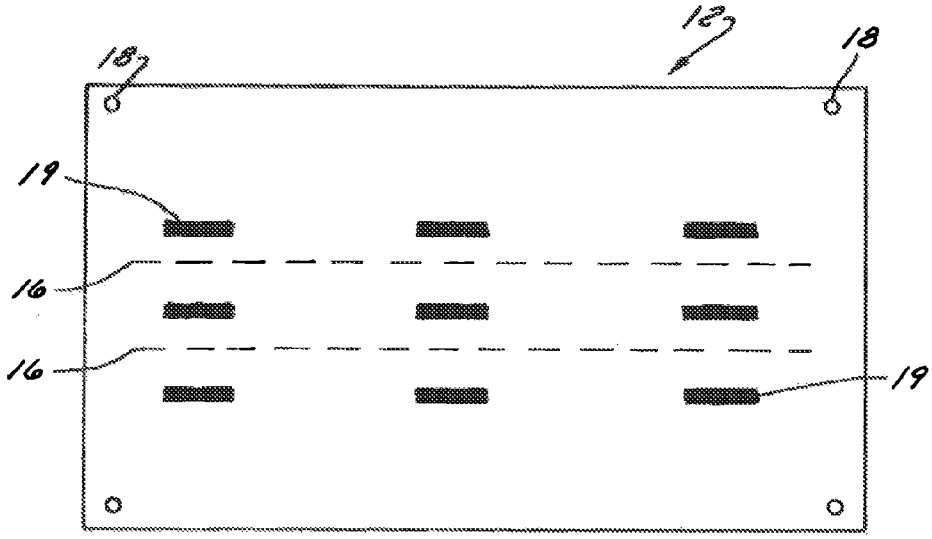
FIG. 4 is a bottom plan view of mattress having slots for receiving massagers.

The bottom of foam mattress 12 is illustrated in FIG. 4. The opening of slits 16 are shown and various numbers of slits 16 may be used. Also seen in FIG. 4 are loop and hook fasteners 19, such as Velcro®. These provide an additional attachment point along with pins 18 to secure mattress 12 to powered foundation 14. However, various fastener systems may be used to secure mattress 12 to powered foundation 14. Slits 16 may be are lined with material containing polytetrafluoroethylene (Teflon®), silicon, tungsten disulfide or other low friction coating to allow the massaging members (not shown) to travel upward through slits 16 to mattress topper 15.

Figure 5:
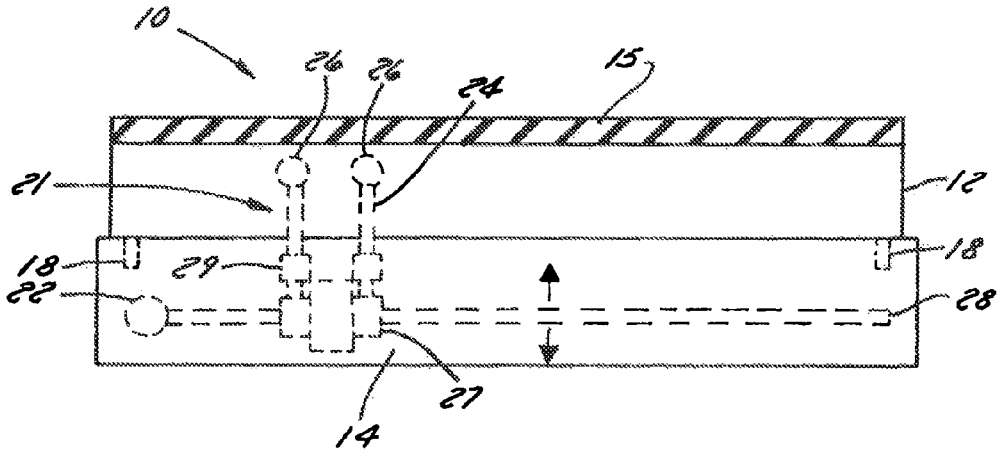
FIG. 5 is a portion of a cross-sectional view of the side of the sleep system powered foundation illustrating one set of massagers and its drive system of one embodiment.

An alternative sleep system 10 is shown in FIG. 5. Mattress 12 sits on top of power foundation 14 as illustrated. Massage actuators 24 are received in mattress slits 16 (shown in FIG. 4) of foam mattress 12. Massager 26 is also received in slit 16 of foam mattress 12 and provides compressive massage as they move along mattress 12 in slits 16. As stated above, slits 16 may be are lined with a fabric containing a low friction coating or fabric impregnated with a low friction material. Foam mattress 12 is composed of open-cell, visco-elastic memory foam and may be composed of multiple layers such as 3 pound density foam submattress (the portion of mattress 12 containing slits 16) and a denser foam, 4 or 5 pound density, for mattress topper 15. As massaging apparatus 21 travels upward from powered foundation 14, massaging apparatus 21 splits open slit 16. Slits 16 are substantially closed when massaging apparatus 21 is retracted in powered foundation 14 or is passed by and foam mattress 12 appears to be a solid mattress. Furthermore, when fully retracted, the resistive compressive properties the slitted submattress of foam mattress 12 remains virtually identical to that of a non-slitted foam mattress of identical foam type and density. Vibrating motors 29 provides vibrating action to massager 26. Likewise, y-axis motor 27 provides massager actuator 24 with up and down massaging action. Mattress topper 15 is an uninterrupted surface and has sufficient foam above massager 26 to provide comfort to the user. Mattress topper 15 may also contain a low friction material or coating where slits 16 stop at mattress topper 15 to reduction wear of mattress topper 16 and reduce frictional heat.

Figure 7:
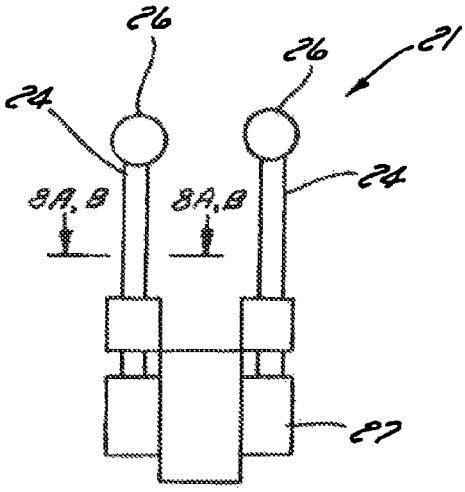
FIG. 7 is a side elevation view of the massager actuator shown in phantom in FIG. 3.
Figure 8A:
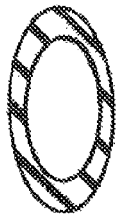
FIGS. 8A and 8B are cutaway views of respective massaging member embodiments taken along line 8A,B-8A,B of FIG. 7.
Figure 8B:
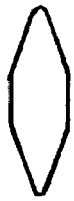

FIG. 7 illustrates massaging apparatus 21 and FIGS. 8A and 8B show embodiments of a cross-sectional view of massage actuator 24. Massage actuator 24 has an aerodynamic cross-sectional shape as such, as those shown in FIGS. 8A and 8B. These shapes help assist in the opening of slits 16 as the massage actuator 24 travels to massage locations and close slit 16 behind it. The cross sectional shape shown in FIG. 8B is shaped such that the leading and trailing edges are curved to open slit 16 and separates as the foam as it travels pasts the side of massage actuator 24 to progressively close. Low friction coatings may be added to massage actuator 24 to reduce friction and abrasion. Various designs of massage actuator 24 may be utilized. The section shown in FIG. 8B separates the slit with low friction and the side shapes, the angled and flat surfaces to minimize the high-pressure regions and therefore reduce the fatigue wear to slits 16. Slits 16 must remain substantially closed to keep the uniformity of foam mattress 12. If slits 16 are allowed to stay open, foam mattress 12 collapses.

Figure 6:
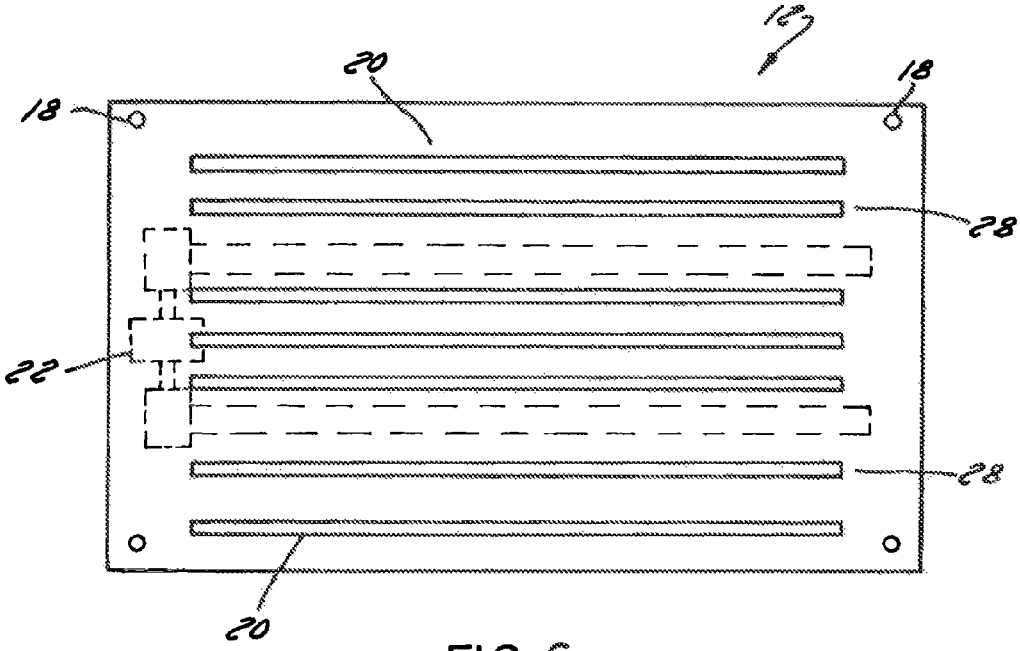
FIG. 6 is a top plan view of the sleep system powered foundation having mechanically and independently adjustable support members.

In an embodiment shown in FIG. 6, motor 22 and cam 28 can be used to provide actuation power to drive shaft 28 which provides longitudinal positioning for massage actuators 24 and massager 26. Additional motors (not shown) perform other functions such driving massager 26 inboard or outboard or providing vibration. Motor (not shown) may be used to drive an elastic cable system (not shown) to drive mechanical actuator 24 and massager 26, drive shaft 28 and associated motor 22 to hoist this assembly vertically upward to mattress topper 15 and user and provide various compressive forces (massage). Alternative, this elastic cable system (not shown) may be used to lower the massaging assembly away from user, to reduce either gradually or abruptly reduce the massaging pressure. This elastic cable system allows the massaging assembly to follow the counter the user's body. Alternative, air controlled actuators may be alternatively utilized in place of mechanical actuator 24. Likewise, various massaging contacts may be utilized in lieu of massager 26.

One embodiment of an actively adjustable firmness sleep system is shown in FIG. 6 that illustrates powered foundation 14 with support members 20. A motor 22 actuates support members 20 via a camshaft 28. To adjust the firmness of foam mattress 12, a support member 20 is raised which locally compresses mattress body 13. A variety of support members 20 can be utilized along the length of foam mattress 12. Multiple motor 22 and cam systems may be utilized to provide support or softness along the foam mattress 12. Support members 20 may be composed of various materials such as wood, plastic, metal, fiberglass, carbon epoxy and other materials.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

I claim:

1. A massaging bed comprising:

a massaging apparatus;

a sleep support comprising (a) a first deformable portion overlying the massaging apparatus having a person-supporting surface, and (b) a second deformable portion underlying the first portion and having an elongate opening in which a portion of the massaging apparatus is received; and wherein the portion of the massaging apparatus is received in the elongate opening in the second portion of the sleep support and underlies the first portion of the sleep support; and wherein the portion of the massaging apparatus received in the elongate opening in the second deformable portion travels along the elongate opening during operation of the massaging apparatus opening one part of the elongate opening where the portion of the massaging apparatus is traveling therealong and substantially closing another part of the elongate opening behind the portion of the massaging apparatus received in the elongate opening.

2. The massaging bed of claim 1 wherein the first deformable portion is comprised of a foam.

3. The massaging bed of claim 2 wherein the first deformable portion is comprised of memory foam.

4. The massaging bed of claim 3 wherein the first deformable portion comprises a mattress topper.

5. The massaging bed of claim 1 wherein the second deformable portion is comprised of a foam.

6. The massaging bed of claim 5 wherein the second deformable portion is comprised of memory foam.

7. The massaging bed of claim 6 wherein the second deformable portion comprises a mattress body.

8. The massaging bed of claim 7 wherein the mattress body comprises a submattress.

9. The massaging bed of claim 1 wherein the first and second deformable portions are comprised of memory foam.

10. The massaging bed of claim 1 wherein the massaging apparatus comprises a massager carriage having a massager motor and wherein the portion of the massaging apparatus received in the elongate opening in the second deformable portion comprises an elongate massager actuator carried by the massager carriage that is operatively connected to a massager head underlying the first deformable portion of the sleep support having a massaging action provided by the massager motor.

11. The massaging bed of claim 1 wherein the second deformable portion has compressive properties substantially that of a deformable portion not having any elongate opening along where the elongate opening is substantially closed.

12. The massaging bed of claim 11 wherein the elongate opening in the second deformable portion comprises a slit.

13. The massaging bed of claim 1 wherein the massaging apparatus comprises a massager drive carrying a massager that is received in the elongate opening in the second deformable portion.

14. The massaging bed of claim 13 wherein the massager comprises a massager head.

15. The massaging bed of claim 13 wherein the massager drive comprises a motor that moves the massager received in the elongate opening along the elongate opening in the second deformable portion.

16. A massaging bed comprising:

a massaging apparatus;

a mattress comprising (a) a first resiliently deformable layer overlying the massaging apparatus having a person-supporting sleep surface, and (b) a second resiliently deformable layer underlying the first layer and having a slit in which a portion of the massaging apparatus is received; and wherein the portion of the massaging apparatus received in the slit underlies the first layer and travels along the slit in the second layer opening one part of the slit where the portion of the massaging apparatus received in the slit is traveling and substantially closing another part of the slit behind the portion of the massaging apparatus received in the slit.

17. The massaging bed of claim 16 wherein the second resiliently deformable layer possesses compressive properties substantially the same as a resiliently deformable layer not having any slit along where the slit is substantially closed.

18. The massaging bed of claim 16 wherein the massaging apparatus comprises a massager drive carrying a massager and wherein the massager comprises the portion of the massaging apparatus received in the slit.

19. The massaging bed of claim 18 wherein the massager comprises a massager head.

20. The massaging bed of claim 19 wherein the massager further comprises an elongate massager actuator extending into the slit in the second resiliently deformable layer with the massager head operatively connected to the massager actuator and underlying the first resiliently deformable layer.

21. The massaging bed of claim 20 wherein the massaging apparatus further comprises a massager carriage from which the massager actuator outwardly extends, and wherein the massager drive comprises a drive motor that moves the massager carriage relative to the mattress moving the massager actuator in the slit along the slit opening the one part of the slit in which the massager actuator is received with the another part of the slit behind the massager actuator substantially closing behind the massager actuator.

22. The massaging bed of claim 21 wherein the massager carriage further comprises a massager motor that communicates a massaging action to the massager head.

23. The massaging bed of claim 22 wherein the massager motor comprises a motor that vibrates the massager head.

24. The massaging bed of claim 20 wherein the first deformable portion is comprised of a foam.

25. The massaging bed of claim 20 wherein the second deformable portion is comprised of a foam.

26. The massaging bed of claim 16 wherein the first resiliently deformable layer comprises a mattress topper and the second resiliently deformable layer comprises a mattress body.

27. The massaging bed of claim 26 wherein the mattress body comprises a submattress.

28. The massaging bed of claim 26 wherein the first resiliently deformable layer is uninterrupted and comprised of memory foam.

29. The massaging bed of claim 28 wherein the second resiliently deformable layer is comprised of memory foam.

30. A massaging bed comprising:

a massaging apparatus comprised of a massager drive operatively connected to a massager;

a mattress comprising (a) an uninterrupted first resiliently deformable layer comprised of memory foam overlying the massaging apparatus and having a surface upon which a person can lay, and (b) a second resiliently deformable layer comprised of memory foam underlying the first resiliently deformable layer and having a slit in which the massager is received; and wherein the massager underlies the first resiliently deformable layer and is urged by the massager drive along the slit in the second resiliently deformable layer opening one part of the slit and substantially closing another part of the slit behind the massager; and wherein the second resiliently deformable layer possesses compressive properties where the slit is substantially closed substantially that of a resiliently deformable layer not having any slit.

31. The massaging bed of claim 30 wherein the first resiliently deformable layer comprises a mattress topper.

32. The massaging bed of claim 30 wherein the second foam layer comprises a submattress.

33. The massaging bed of claim 30 wherein the second foam layer comprises a mattress body.

34. The massaging bed of claim 30 wherein the massager comprises (a) an elongate generally vertically extending massager actuator received in the slit, and (b) a massager head underlying the first resiliently deformable layer with the massager head operatively connected to a free end of the massager actuator.

35. A massaging bed comprising:

a massaging apparatus comprised of a massager drive in operable cooperation with a massager head;

a mattress comprising (a) a memory foam topper, and (b) a memory foam submattress having a slit in which the massager head is received; and wherein the massager head underlies the mattress topper and is urged by the massager drive along the slit in the submattress opening one part of the slit in which the massager head is received and substantially closing another part of the slit behind the massager head; and wherein the compressive properties of the submattress where the slit is substantially closed is substantially the same as a memory foam submattress not having any slit.

36. The massaging bed of claim 35 wherein the massaging apparatus further comprises an elongate massager actuator extending generally upwardly into the slit that is operatively connected to the massager head.

* * * * *